United States Patent [19]

Glaser

[11] 4,413,749

[45] Nov. 8, 1983

[54] NEWSPAPER DISPENSING APPARATUS AND METHOD

[75] Inventor: Robert L. Glaser, Chicago, Ill.

[73] Assignee: Single Vend, Inc., Chicago, Ill.

[21] Appl. No.: 270,930

[22] Filed: Jun. 5, 1981

[51] Int. Cl.[3] ..... B65H 3/22

[52] U.S. Cl. ..... 221/1; 221/213; 221/227; 221/248

[58] Field of Search ..... 221/213, 214, 228, 232, 221/236, 238, 247, 248, 262, 268, 269, 1

[56] References Cited

U.S. PATENT DOCUMENTS

| | | | |
|---|---|---|---|
| 1,622,262 | 3/1927 | Kindrat et al. | 221/214 X |
| 2,522,033 | 9/1950 | Graham | 221/232 X |
| 2,854,168 | 9/1958 | Abrams et al. | 221/213 X |
| 2,870,939 | 1/1959 | Etes et al. | 221/213 |
| 3,263,859 | 8/1966 | Searle | 221/213 X |
| 4,273,255 | 6/1981 | Overall | 221/213 |

*Primary Examiner*—Stanley H. Tollberg
*Assistant Examiner*—Kevin P. Shaver
*Attorney, Agent, or Firm*—Merriam, Marshall & Bicknell

[57] ABSTRACT

A mechanism for dispensing a single generally flat rectangular article having a penetrable surface, such as a newspaper, from a stack of articles within an enclosure, preferably a coin controlled enclosure, comprising a spring loaded vertically movable generally horizontally disposed elevator platform for supporting a stack of articles and an article engaging structure mounted above the stack including a reciprocable bracket movable forwardly, rearwardly and vertically having spaced pin brackets which are pivotally moveable about an axis parallel with the lateral walls of the enclosure with each of the brackets having a depending article penetrating structure adapted to engage and move the uppermost article in the stack outwardly through an article dispensing opening in the front wall of the enclosure when the bracket is moved into its forwardly position. The reciprocably movable bracket has associated therewith a slide plate and lever assembly for engaging a spring biased inner gate closure which normally closes the article dispensing opening and moving the inner gate closure to open position before the article penetrating structure moves the article into the dispensing opening. The article engaging structure has a lever arm operatively associated therewith which is adapted to exert a braking force on the vertical movement of the elevator platform when a predetermined upwardly pressure is applied to the article penetrating structure by the uppermost article in the stack.

10 Claims, 13 Drawing Figures

FIG. 6
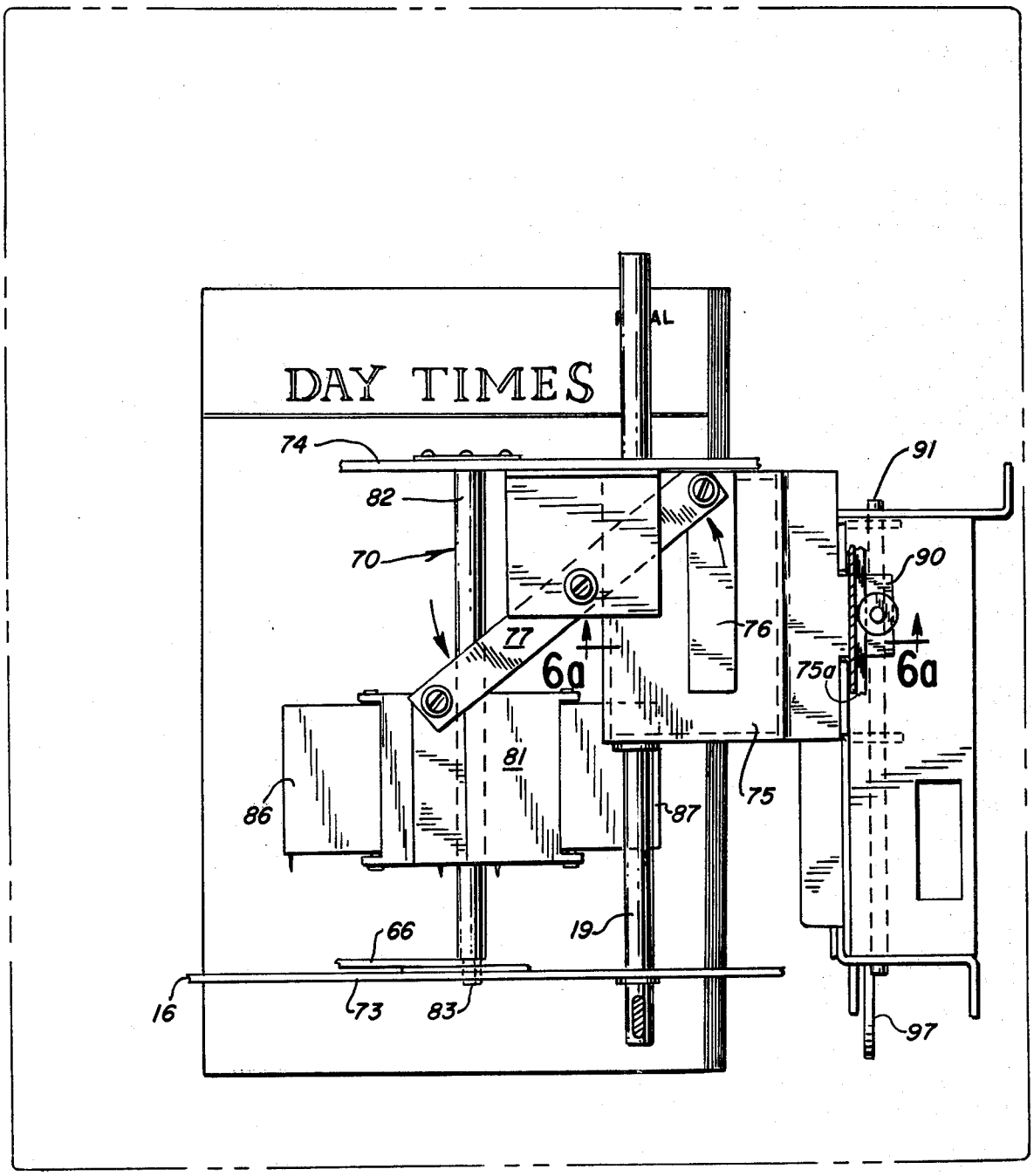
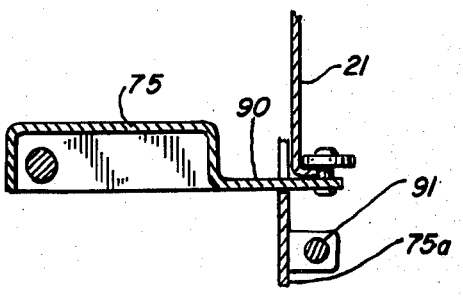
FIG. 6a

NEWSPAPER DISPENSING APPARATUS AND METHOD

The present invention relates generally to a method and apparatus for dispensing an article one at a time from a stack of the articles, and more particularly to a method and apparatus for dispensing a single newspaper, magazine and like generally flat article from a coin-controlled vending machine.

In order to prevent the removal of two or more articles from a vending machine where insertion of a coin gives access to a stack of newspapers in the vending machine, it is desirable to provide a vending machine for newspapers and the like articles which will dispense only a single article from a stack of such articles within the machine in response to each coin controlled operation of the vending apparatus. While many such machines have been designed, there has been no entirely satisfactory vending machine of this type, because of difficulties encountered in ejecting only one article at a time, displacing or damaging the article being ejected, requiring special stacking arrangement of the articles, using complex means to prevent tampering, expensive construction and requiring substantial maintenance or repair expenses for the apparatus. A further difficulty encountered with the prior newspaper vending machines has been the inability of the machines to dispense large metropolitan newspapers and Sunday editions of newspapers in addition to regular daily editions of the newspapers. A particular problem is encountered when the large newspapers contain one or more magazine inserts or advertising folders and the like inserts which cause a stack of such articles to present a non-planar upper surface.

It is therefore an object of the present invention to provide an improved method of dispensing a single article, such as a newspaper, from the top of a stack of such articles from within an enclosure.

Another object of the invention is to provide an improved mechanism for dispensing a single article from a stack of such articles within an enclosure in response to each operation of the mechanism without opening the door of the enclosure which is normally used to stack the articles in the vending machine.

Still another object of the invention is to provide a dispensing mechanism in which all of the operations thereof are effected by the movement of the article dispensing means.

An additional object of the invention is to provide a dispensing apparatus for ejecting a single article from within an enclosure which is more economical to construct and requires less maintenance then previous apparatus for dispensing similar articles.

A further object of the invention is to provide a vending apparatus for dispensing newspapers folded in the usual manner which can be rapidly loaded and reloaded with newspapers or like articles to form a stack within the apparatus without regards to arranging the folded edge of the papers along the same side of the stack.

Other objects of the invention will be apparent from the specification and claims to follow when read in conjunction with the accompanying drawing wherein;

FIG. 6 is a fragmentary top plan view of a portion of the operating mechanism partially shown in FIG. 2;

FIG. 6*a* is a fragmentary vertical sectional view taken along the line 6*a*—6*a* of FIG. 6.

Figure 1:
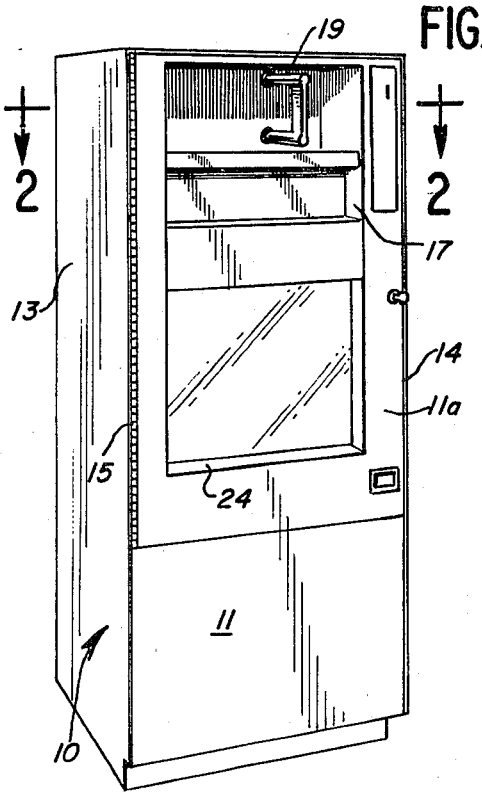
FIG. 1 is a front perspective view of an article dispensing mechanism embodying the present invention.
Figure 3:
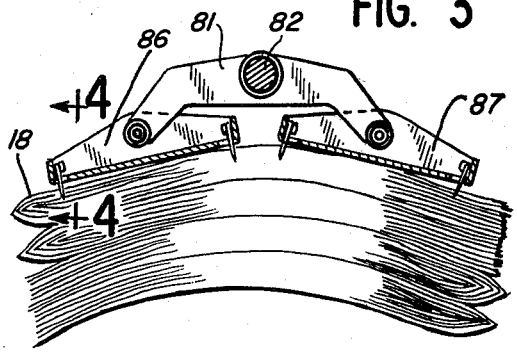
FIG. 3 is a fragmentary vertical sectional view taken along the line 3—3 of FIG. 2.
Figure 4:
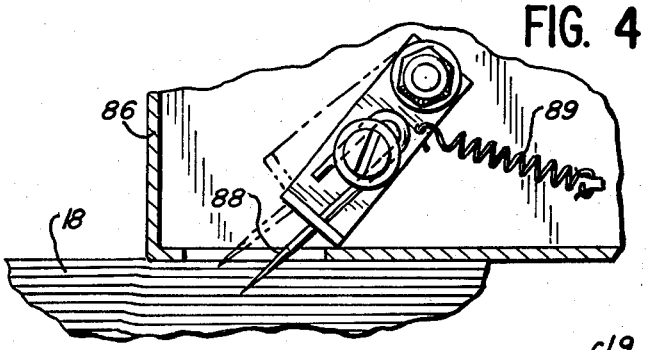
FIG. 4 is a fragmentary vertical sectional view taken along the line 4—4 of FIG. 3.
Figure 2:
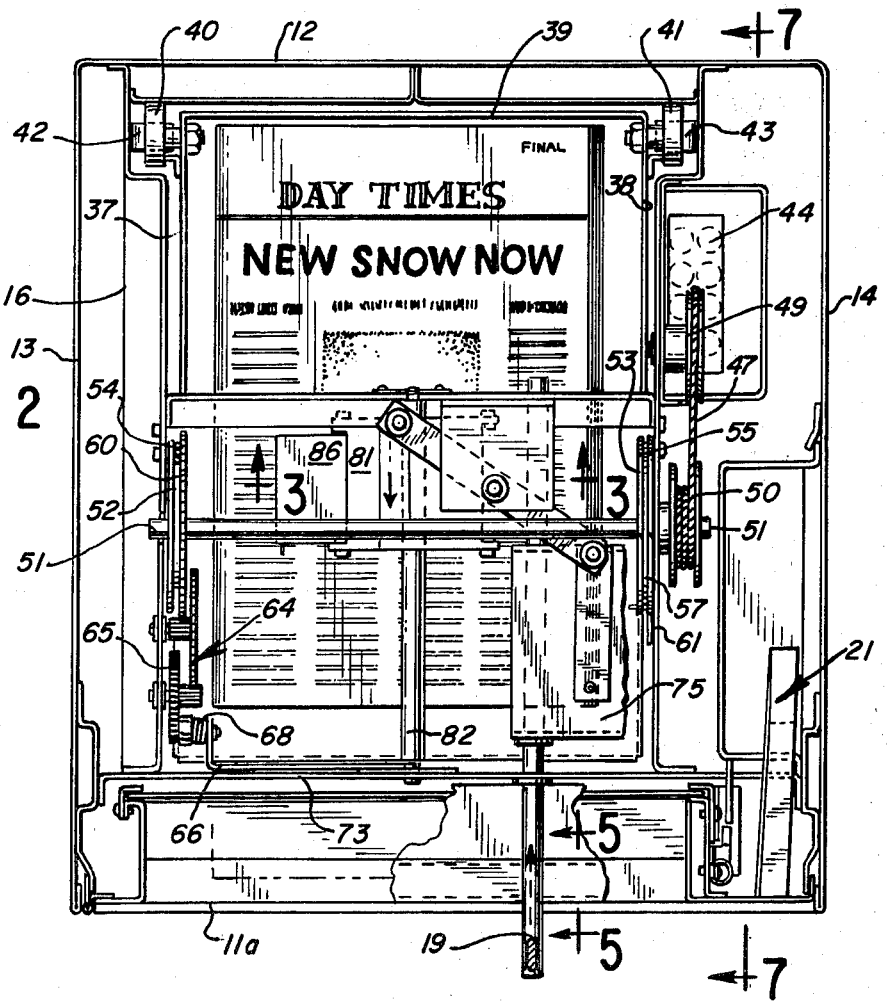
FIG. 2 is a horizontal sectional view partially in elevation taken along the line 2—2 of FIG. 1.
Figure 5:
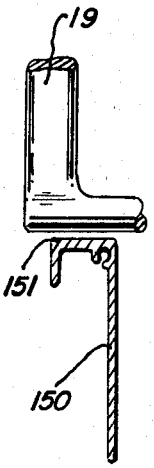
FIG. 5 is a fragmentary vertical sectional view taken along the line 5—5 of FIG. 2.
Figure 7:
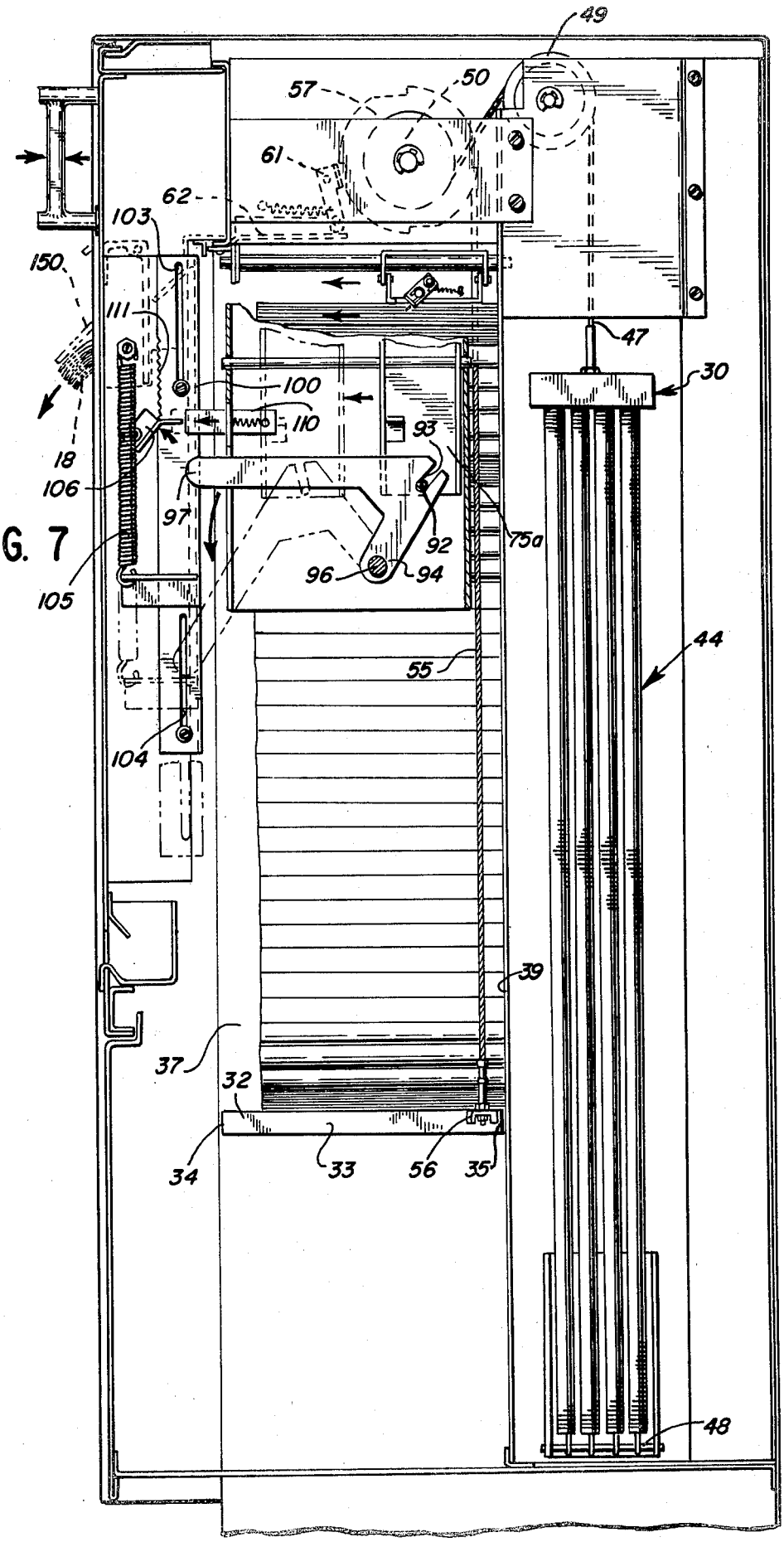
Figure 8A:
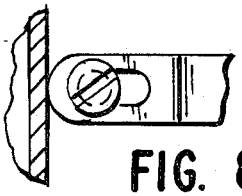
Figure 8:
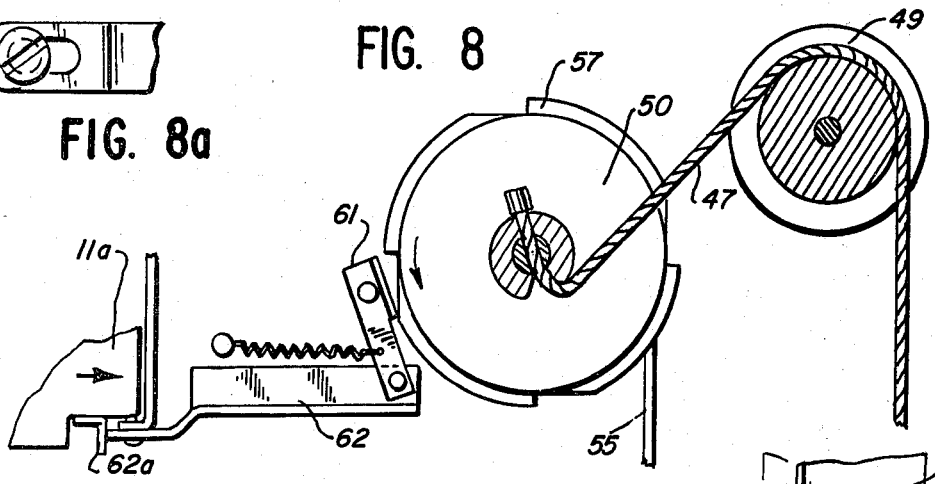
Figure 9:
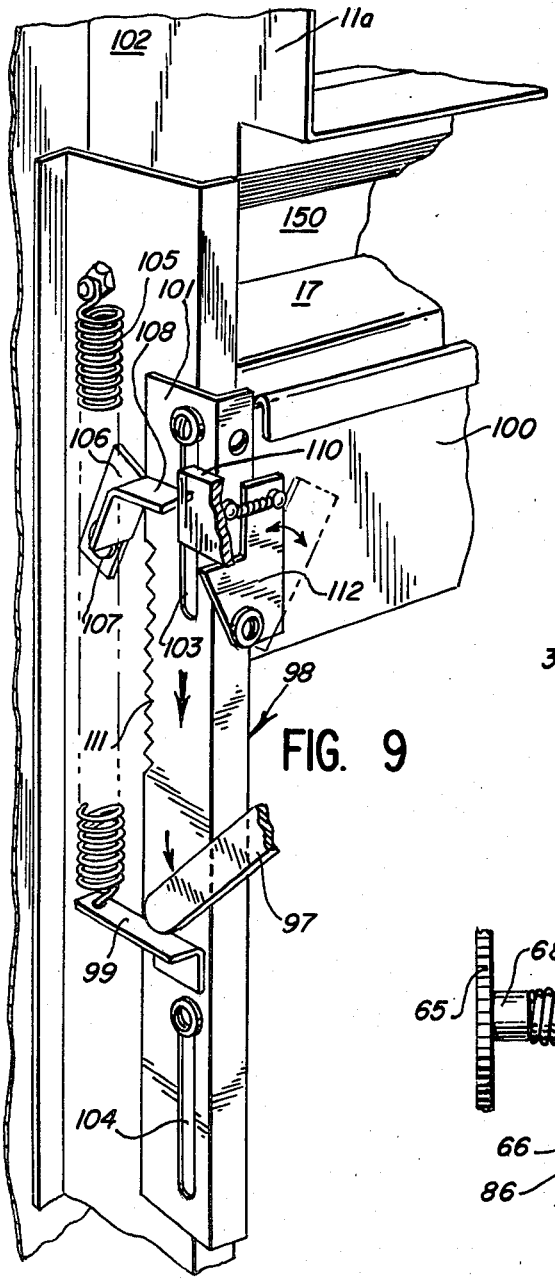
Figure 10:
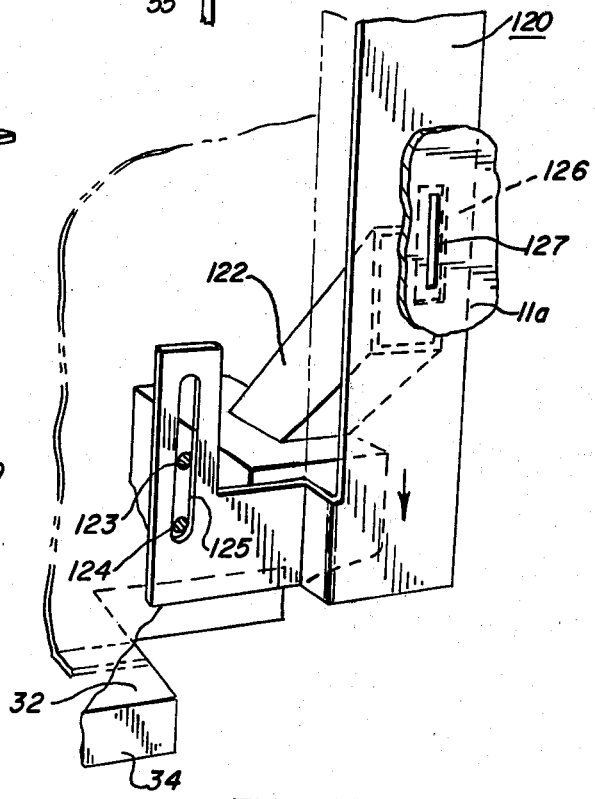
Figure 11:
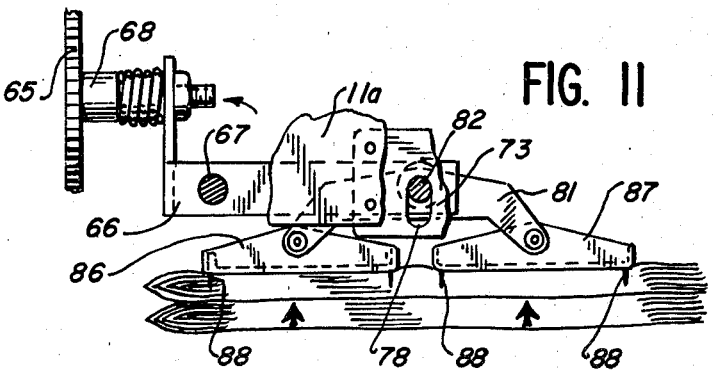

FIG. 7 is a fragmentary vertical sectional view partially in elevation taken along the line 7—7 of FIG. 2;

FIG. 8 is a fragmentary vertical sectional view partially in elevation of a portion of the operating mechanism shown in FIG. 7;

FIG. 8*a* is a fragmentary vertical sectional view partially in elevation showing a portion of the structure of FIG. 8;

FIG. 9 is a fragmentary rear perspective view of a portion of the operating mechanism shown in FIG. 7 in a different operation position;

FIG. 10 is a fragmentary perspective view of a portion of the apparatus associated with a coin receiving mechanism; and FIG. 11 is a fragmentary elevational view partially in vertical section of a portion of the apparatus associated with the braking mechanism.

A dispensing mechanism embodying the present invention comprises a cabinet 10 forming an enclosure comprising front, rear and lateral walls 11, 12, 13 and 14, respectively. The front wall 11 is provided with a door or front wall section 11*a* hingably mounted at 15. The cabinet 10 comprises a frame assembly 16 supported by the walls of the cabinet 10. The frame assembly 16 supports an article supporting platform and elevator means 30 which is adpated to support a plurality of generally flat articles, such as newspapers, thereon in the form of a stack and move the stack upwardly as successive articles are removed from the stack. When the articles comprise newspapers, the papers are stacked with the folded edge portion thereof parallel with either of the lateral wall of the cabinet 10 but not the front or rear walls of the cabinet 10 and preferably with an equal number of the papers in the stack having their folded edge adjacent opposite lateral walls of the cabinet 10 so that the stacked papers form a generally level upper surface and avoid having one edge of the stack significantly higher than the other edge of the stack, as would be the case if all of the folded edges of the newspapers, particularly large papers, were adjacent one side of the cabinet.

The front wall section 11*a* is provided with a generally rectangular discharge passage or dispensing opening 17 which is in unobstructed communication with the interior of the cabinet 10 through which a portion of an article 18, such as a newspaper, is projected at the end of each operating cycle of the vending machine. Extending outwardly through the front wall section 11*a* is a horizontally reciprocable push-pull ejecting or operating lever 19 adapted for manually operating an article dispensing mechanism. Coin controlled mechanism 21 is adapted to prevent the reciprocable movement of the operating lever 19 unless the proper type and amount of coins have been inserted into the coin receiving slot.

A large rectangular passage 24 is preferably formed in the lower portion of the front wall section 11*a* to provide a window for displaying the article being dispensed in the apparatus. A display compartment behind the display window is formed by providing a narrow lower wall, a rearwardly and upwardly extending inner wall and lateral walls extending perpendicularly from the inner surface of the front wall 11*a*. The passage 24 is preferably closed by a section of transparent material.

The arrangement within the cabinet 10 of the article supporting platform and elevator means 30 and the article dispensing or ejector mechanism are best shown in FIGS. 2, 6 and 7 of the drawing. The article supporting platform and elevator means 30 is preferably spring loaded for vertical reciprocable movement along a vertical track in the frame assembly 16 and comprises a generally rectangular horizontally disposed elevator platform or support member 32 having rigid depending lateral walls 33 and depending front and rear walls 34, 35, respectively. The horizontally disposed platform 32 also preferably has lateral walls 37, 38 and rear wall 39 which extend upwardly about 8 inches above the horizontal platform 32. At points adjacent the upper and lower rear edges of the lateral walls 37, 38 a pair of longitudinal guide rollers 40, 41 and transverse guide rollers 42, 43 extend outwardly therefrom and are adapted to form a rolling contact with the track formed by the frame 16, thereby enabling the article supporting platform 32 to be readily moved reciprocably within the cabinet with minimal forward or lateral movement and with reduced frictional resistance.

The article positioning platform 32 is yieldably supported for vertical reciprocable movement within the frame assembly 16 by providing yielding means comprising coil springs 44 having their upper ends secured to a cable 47, as shown in FIG. 7 with their lower ends secured, as at 48 in FIG. 7, to the frame 16. The yielding means is adapted to provide an upwardly force slightly in excess of the force required to urge the articles supported on the elevator platform 32 upwardly when the platform 32 is fully loaded with articles to be dispensed. The upper end of the cable 47 is guided over a pulley 49 and is secured to a drum 50 mounted on a shaft 51 rotatably supported in the frame 16. The shaft 51 also is provided at points spaced inwardly from the opposite ends thereof with drums 52, 53. The drums 52, 53 have one end of a cable 54, 55, respectively, secured to the article supporting platform 32, as illustrated at 56. Drum 53 has a ratchet wheel 57 associated therewith and a reciprocably spring pressed pivotal pawl 61 mounted on the frame 16 adapted to arrest the rotation of shaft 51 and hold the supporting platform 32 stationary against the tension of springs 44 when the door 11*a* is opened and the platform 32 moved into loading position adjacent the lower end of the enclosure to facilitate stacking articles on the platform 32. A reciprocable pawl release actuating arm 62 is mounted on frame 16 with its inner end pivotally connected with the lower end of the pivotal pawl 61 and the outer end thereof extending forwardly so that when the hinged door or front wall section 11*a* is moved into closed position after the loading operation is completed, the actuating arm 62 is engaged by a stop member 62*a* on the door 11*a* and moved inwardly and disengages the pawl 61 from the ratchet wheel 57.

The rotatable shaft 51 also has mounted thereon adjacent drum 52 a gear 60 having associated therewith a plurality of sprocket wheels and gears of successively reduced diameter forming a gear train 64 extending forwardly within the enclosure terminating with gear 65. A brake lever arm 66 is pivotally mounted at 67 on plate 73. The inner end of the lever arm 66 is connected by means of a yoke with the outer or forward end of rod 82 which supports the article dispensing brackets 81 and pin brackets 86 and 87. The outer end of the lever arm 66 is provided with an upwardly extending flange which has extending horizontally outwardly therefrom a spring biased brake shoe 68 which is adapted to engage the lateral surface of the terminal gear 65 of the gear train 64 which is operatively connected with the shaft 51. When the inner end of the lever arm 66 is moved upwardly by pressure applied by the uppermost article in the stack of articles 18 supported on the platform 32, the brake shoe 68 is moved into frictional engagement with the gear 65, causing the shaft 51 to stop rotating so that there is no additional upwardly pressure applied to the brackets 86, 87 and pins 88 supported therein during the dispensing operation. As soon as the article 18 is dispensed through opening 17, the lever arm 66 and associated elements move downwardly, permitting rotation of the shaft 51 and allowing upwardly movement of the stack of articles 18 supported on the platform 32.

The article dispensing means 70 mounted within the frame assembly 16 adjacent the upper end of the enclosure comprises a push-pull ejecting or operating lever 19 supported by spaced plates 73, 74 of the frame 16. The push-pull operating lever 19 has a reciprocable push-pull bracket 75 affixed thereto with the bracket 75 having a link 76 connected with one end of an arm 77 pivotally mounted at its midpoint on the frame 16. The other end of the arm 77 is connected to a support bracket 81 which is longitudinally reciprocably movable on a support rod 83 having its outer end 83 mounted in plate 73 for vertical movement in slot 78 formed in a fixed front support plate 73. The bracket 81 has laterally spaced article engaging pin brackets 86, 87 depending therefrom and pivotally movable about an axis parallel with the axis of rod 82 which is substantially parallel with the lateral walls of the enclosure. The article engaging pin brackets 86, 87 are preferably provided with downwardly and forwardly inclined article penetrating pins 88 extending a short distance below the lower surface of the pin brackets and pivotal in a plane generally perpendicular to the lower surface of the support means and normally urged downwardly by spring means 89 to insure penetrating engagement of the pins 88 with the upper surface of the article 18 when the bracket 81 is moved forwardly. When the article 18 is withdrawn through the dispensing opening 17, the penetrating pins 88 are pivoted upwardly by the outwardly movement of the article 18, and the article 18 is readily withdrawn through the discharge opening without damaging the article.

Means for preventing an individual gaining access to the interior of the dispensing enclosure are provided which include an outer closure flap 150 and inner gate assembly 98 for blocking the dispensing opening 17. The inner gate assembly 98 is mounted on the front wall section 11*a* for yieldable vertical reciprocable movement thereon and is positioned so as to normally close the dispensing passage or opening 17 through which an article 18 is dispensed during normal operation of the apparatus. The inner gate assembly 98 is comprised of an inner gate comprising a rectangular plate 100 having a vertically reciprocable L-shaped plate 101 secured thereto. The plate 101 is mounted on the lateral edge of spaced support members 102 mounted on the front wall section 11*a*. The plate 101 is provided with a pair of spaced slots 103, 104 having a length sufficient to allow the plate 100 to be moved downwardly a distance sufficient to fully clear the dispensing opening 17 when in the lowered reciprocable position (See FIG. 9) and to be moved upwardly sufficient to completely close the discharge opening 17 when the plate 101 is moved to its maximum upwardly position (See FIG. 7). The plate 101 is normally yieldably held in the maximum upwardly position by means of spring means 105 having the lower end secured to a stop member 99 on the plates 101 and having the upper ends of the spring means 105 secured to the support member 102 preferably at a point above the upper end of the plate 101. The inner gate 100 is normally held in closed position by means of an inner gate lock member 106 pivotally mounted on the fixed support member 102, as at 107. The lock member 106 engages the rear edge of a one-way ratchet section 111 formed on the outer edge of the plate 101. The inner gate lock member 106 is provided with an inwardly or rearwardly extending section 108 which is adapted to engage with a reciprocable spring biased release arm 110 when the slide plate 75*a* which is operatively connected with the push-pull operating lever 19 and bracket 75 is moved forwardly and effects disengaging the inner gate lock member 106 from the ratchet section 111. In order to move the inner gate 100 downwardly to open the dispensing passage 17 during the dispensing operation, means are provided which comprise the push-pull bracket 75 which is operatively connected to and moves reciprocably with the push-pull operating lever 19. The bracket 75 has a laterally extending tongue section 90 to which is connected operatively with depending slide plate 75*a* supported on a rod 91 and adapted to be reciprocably movable with said article ejector bracket 75 and operating lever 19. The tongue section 90 is adapted to move reciprocably in a horizontal slot formed in the coin mechanism housing. The slide plate 75*a* is provided with an actuating pin 92 which engages in a slot 93 formed in an angle arm 94 which is mounted on a fixed pivot 96 on frame 16 such that when the slide plate 75*a* is moved forwardly the outer end 97 of the arm 94 moves downwardly and engages the stop element 99 on the plate 101 to effect downwardly movement of the inner gate 100. In order to keep the inner gate in lowered position until the article is moved into the discharge opening 17 and inner gate latch means is provided comprising a spring biased pivotal latch element 112 which hold the inner gate 100 down until the release arm 110 is withdrawn as the slide plate 75*a* moves inwardly allowing the article to move into the discharge passage 17 before the gate 100 is free to move upwardly into closed position. When the slide plate 75*a* is moved rearwardly it effects movement of the release arm 110 by engaging a flange thereon after the dispensing means has moved at least a portion of the uppermost article 18 on the stack outwardly through the dispensing opening 17 and allowing the inner gate lock member 106 to engage the one-way ratchet section 111 of the plate 101. When the article 18 is completely removed from the opening 17, the one-way ratchet permits movement of the inner gate to completely close the discharge opening 17.

As a further tampering prevention means operative during a portion of the dispensing operation, the upper end of the outer closure flat 150 which is pivotally mounted on the outer edge of the dispensing opening 17 directly below operating lever 19 is provided with a flange 151 at the upper end thereof which prevents the flap 150 being moved into open position, because of the interference between the push-pull lever 19 and the flange 151.

In order to prevent the insertion of a coin into the coin mechanism when all of the articles have been dispensed from the apparatus means for blocking the coin receiving slot are provided which comprise mounting a vertically movable plate 120 between the front wall 11*a* and the coin shoot 122. The plate 120 is normally held in its maximum upwardly position by engagement with an article supported on the platform 32. Pins 123, 124 mounted on the coin mechanism housing extend through a vertical slot 125 formed in the plate 120. The plate 120 also has a slot 126 formed therein at a position directly opposite the coin slot 127 formed in the front wall section 11*a*. When all of the articles have been removed from the platform 32, the plate 120 falls downwardly, because of the cut-out portion formed in the front corner of the platform 32 which is normally completely covered by the article on the platform 32 is exposed and no support is provided for the plate 120. When the plate 120 falls to its lower position, the upper end of plate 120 which does not have a slot formed therein is positioned directly opposite the coin receiving slot 125 and prevents the insertion of coins into the slot 127.

I claim:

1. In a mechanism for dispensing a single generally flat article such as a newspaper from within an enclosure comprising front, rear and lateral walls having a supporting frame assembly and a dispensing passage formed in the front wall of said enclosure adjacent the upper end thereof, a generally horizontally disposed article supporting platform and elevator means supported by said frame with said platform adapted for yieldable vertical reciprocable movement within said enclosure and adapted to support a plurality of generally flat articles in the form of a stack thereon; an article dispensing means mounted within said frame above said supporting platform adjacent the upper end of said enclosure on a support rod normally extending horizontally and disposed in a plane parallel to said lateral walls with said dispensing means adapted for reciprocable movement along said support rod toward and away from said dispensing passage, said supporting rod for said article dispensing means adapted to have one end thereof movable in a vertical plane, said dispensing means comprising laterally spaced article engaging means with said article engaging means adapted for pivotal movement about an axis parallel with said support rod to facilitate forming an article moving engagement with the upper surface of the uppermost article in said stack when said article dispensing means is moved forwardly toward said dispensing passage, and operating means adapted to effect reciprocable movement of said article dispensing means.

2. A dispensing mechanism as in claim 1, wherein said one end of said supporting rod for said article dispensing means is adapted to be moved vertically in response to upwardly pressure applied to said article engaging means by said uppermost article in said stack, and said one end is operatively associated with a braking means adapted to stop vertical movement of said article support platform when a predetermined upwardly pressure is applied to said article engaging means by said uppermost article in said stack.

3. A dispensing mechanism as in claim 2, wherein said article engaging means comprises laterally spaced brackets having article piercing pins depending therefrom which are adapted to form a piercing engagement with said uppermost article in the stack.

4. In a dispensing mechanism for generally flat articles, an enclosure comprising front, rear and lateral walls having a supporting frame assembly disposed therein and a dispensing passage formed in the front wall of said enclosure adjacent the upper end thereof, a yieldable vertically reciprocable inner gate closure mounted on a front wall section of said enclosure and adapted normally to be yieldably moved to close said dispensing passage, a generally horizontally disposed article supporting platform and elevator means mounted in said frame assembly with said platform adapted for yieldable vertical reciprocable movement within said enclosure and adapted to support a plurality of generally flat articles in the form of a stack thereon, an article dispensing means mounted within said frame assembly above said supporting platform and adjacent the upper end of said enclosure, said dispensing means reciprocably movable horizontally on a support rod disposed parallel with said lateral walls toward and away from said dispensing passage, said article dispensing means comprising a horizontally reciprocable bracket having operatively associated therewith a downwardly extending slide plate disposed in a vertical plane and spaced laterally of said dispensing opening, inner gate locking means mounted on said frame adapted to engage said inner gate closure and lock said inner gate closure in closed position at the end of an operating cycle, said slide plate reciprocably movable with said bracket and adapted to release said inner gate locking means when said bracket and slide plate are moved forwardly, lever means pivotally mounted on said frame assembly adapted to be actuated by said slide plate when said bracket and slide plate are moved forwardly and effect moving said inner gate closure downwardly into open position after release of said inner gate locking means prior to said article dispensing means moving said article into said dispensing passage, spring biased inner gate latch means adapted to hold said inner gate closure in open position until said bracket is moved reciprocably rearwardly away from said dispensing passage, and operating means adapted to effect reciprocable movement of said article dispensing means.

5. A dispensing mechanism as in claim 4, wherein said inner gate locking means comprise a pivitol pawl mounted on said frame so as normally to engage a one-way ratchet plate fixedly connected with said inner gate closure.

6. A dispensing mechanism as in claim 4, wherein said inner gate locking means comprises a lock release arm element having a flange on the inner end thereof adapted to be engaged by said slide plate to effect movement of said element when said bracket is moved reciprocably forwardly.

7. In a dispensing mechanism for generally flat articles, an enclosure comprising front, rear and lateral walls having a supporting frame disposed therein and a dispensing passage formed in a front wall section of said enclosure adjacent the upper end thereof, a generally horizontally disposed article supporting platform and platform elevator means supported by said frame with said platform adapted for yieldable vertical reciprocable movement within said enclosure while supporting a plurality of generally flat articles in the form of a stack, a generally horizontally reciprocable article dispensing means mounted within said frame above said supporting platfom and adjacent the upper end of said enclosure, said dispensing means supported on a rod disposed in a plan parallel to said lateral walls with said dispensing means reciprocably movable along said rod toward and away from said dispensing passage, said rod having one end reciprocably movable in a verticle plane, said platform being yieldably supported by a flexible element having one end secured to the said platform and adapted to be wound about a drum mounted on a shaft disposed parallel with the front and rear walls of said enclosure and rotatably supported in said frame, said shaft being operatively connected by means of a flexible element with a spring means which is anchored to said frame assembly and which is adapted to move said platform with said stack of flat articles vertically, said shaft having a gear mounted thereon which is connected with a gear train supported by said frame, a lever arm pivotally mounted on said frame and having one end operatively connected with the said one end of said rod supporting said article dispensing means and the other end of said lever arm having a brake shoe adapted to be moved into braking engagement with the lateral surface of a gear at the end of said gear train, said brake shoe adapted to stop the rotation of said shaft and prevent further upwardly movement of said article supporting platform when upwardly pressure is applied at said one end of said rod through said article dispensing means by the uppermost article in said stack, and operating means adapted to effect reciprocable movement of said article dispensing means.

8. In a mechanism for dispensing a single generally flat article, such as a newspaper, from within an enclosure comprising front, rear and lateral walls having a supporting frame assembly and a dispensing passage formed in the front wall of said enclosure adjacent the upper end thereof, and a generally horizontally disposed article supporting platform and elevator means supported by said frame with said platform adapted for yieldable vertical reciprocable movement within said enclosure and adapted to support a plurality of generally flat articles in the form of a stack thereon; an article dispensing means mounted within said frame above said supporting platform adjacent the upper end of said enclosure on a support rod normally extending horizontally and disposed in a plane parallel with said lateral walls and said dispensing means adapted for reciprocable movement along said support rod toward and away from said dispensing passage, said supporting rod for said article dispensing means adapted to have one end thereof movable in a verticle plane, said dispensing means comprising laterally spaced article engaging means each adapted for pivotal movement about an axis parallel with said support rod to facilitate forming an engagement with the upper surface of the uppermost article in said stack when said upper surface does not lie entirely in a single plane, and a manually actuated operating means adapted to effect reciprocable movement of said article dispensing means.

9. A method of dispensing a single generally flat article, such as a newspaper, from within an enclosure having front, rear and lateral walls which comprises; forming a stack of said articles on a supporting elevator platform mounted within said enclosure; arranging said articles in said stack with any folded edge parallel with the lateral walls of said enclosure, positioning said stack directly below an article engaging means adapted to engage the uppermost article in said stack, moving said elevator platform to bring the uppermost article in said stack into engagement with said article engaging means, braking the movement of said elevator platform in response to a predetermined pressure being applied to said article engaging means by said uppermost article in said stack, and moving said article engaging means forwardly while in engagement with said uppermost article to dispense a portion of said uppermost article outwardly from within said enclosure, whereby the pressure between said article engaging means and said uppermost article in said stack is directly controlled to prevent applying an excessive amount of pressure on said article engaging means; thereby avoiding having more than one article dispensed from said enclosure with each forward movement of said article engaging means.

10. A method as in claim 9, wherein said article engaging means comprises laterally spaced brackets having article piercing pins depending therefrom.

* * * * *